United States Patent [19]

Kobayashi

[11] Patent Number: 4,909,176

[45] Date of Patent: Mar. 20, 1990

[54] SMALL SIZED JET PROPULSION BOAT

[75] Inventor: Noboru Kobayashi, Iwata, Japan

[73] Assignee: Yamaha Hatsudoki Kabushiki Kaisha, Iwata, Japan

[21] Appl. No.: 260,940

[22] Filed: Oct. 21, 1988

[51] Int. Cl.[4] ..... B63B 35/84

[52] U.S. Cl. ..... 114/343; 114/123; 114/270

[58] Field of Search ..... 114/61, 123, 270, 343; 440/38; 441/80

[56] References Cited

U.S. PATENT DOCUMENTS 3,126,558 3/1964 Nolan et al. ..... 114/123
4,320,713 3/1982 Nishida et al. ..... 114/123
4,694,770 9/1987 Kitner et al. ..... 114/123

FOREIGN PATENT DOCUMENTS 96193 5/1987 Japan ..... 441/80
8705273 9/1987 World Int. Prop. O. ..... 114/123

*Primary Examiner*—Sherman D. Basinger
*Assistant Examiner*—Stephen P. Avila
*Attorney, Agent, or Firm*—Ernest A. Beutler

[57] ABSTRACT

A small watercraft of the jet propelled type having a pair of removable side containers adapted to be mounted on the sides of the hull so as to provide storage area and increased buoyancy.

6 Claims, 3 Drawing Sheets

SMALL SIZED JET PROPULSION BOAT

BACKGROUND OF THE INVENTION

This invention relates to an improved small sized jet boat and more particularly to an improved hull for such a boat.

A very popular type of small watercraft is designed to be operated by a single rider that is seated in a straddle type fashion on the hull of the watercraft with his feet placed on sides of the deck or in foot well portions. This type of watercraft is normally powered by a jet propulsion unit and is extremely sporting in nature. It is important for the handling and sporting characteristics to maintain a relatively narrow hull. As a result, this type of watercraft has little utility other than sporting operation.

However, many owners of this type of watercraft would also like to be able to employ the watercraft for other uses. For example, this type of watercraft could lend itself admirably to uses such as fishing or the like. However, the size of the watercraft makes it impossible to carry any other material such as fishing materials on the boat. Also such boats are not particularly suited to long distance cruising.

It is, therefore, a principal object of this invention to provide an improved hull configuration for a small watercraft that includes detachable containers for carrying additional objects.

It is a further object of this invention to provide an improved convertible hull for a small watercraft that can be used for sporting or utility purposes.

With small watercraft of the type described, a novice rider may experience some difficulty in handling the watercraft until he becomes more acquainted with it. Also, the hull, because of its sporting nature, may not offer the desired stability under all conditions.

It is, therefore, a still further object of this invention to provide an improved hull arrangement for a small watercraft which is convertible between a sporting and a more stable arrangement.

SUMMARY OF THE INVENTION

This invention is adapted to be embodied in a hull configuration for a small watercraft that is comprised of a bow portion and a stern portion and which defines a rider's area therebetween. The hull is defined at least in part by a pair of upstanding sidewalls. In accordance with the invention, means are provided for detachably affixing a pair of containers, one to each of the upstanding sidewalls.

DETAILED DESCRIPTION OF THE PREFERRED EMBODIMENT OF THE INVENTION

Figure 1:
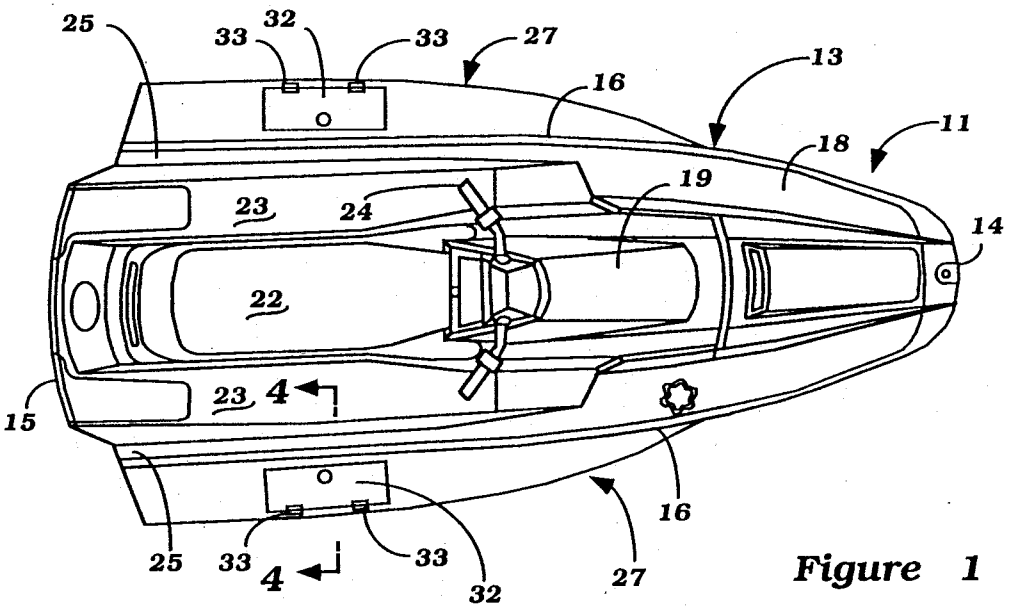
FIG. 1 is a top plan view of a small watercraft constructed in accordance with an embodiment of the invention with the side containers attached.
Figure 2:
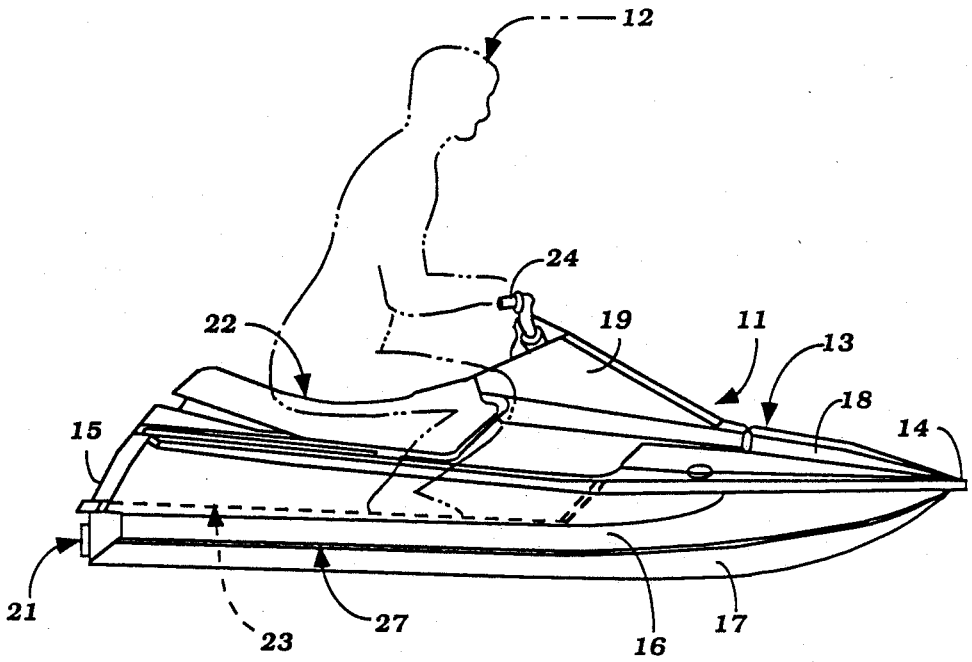
FIG. 2 is a side elevational view of the watercraft.
Figure 3:
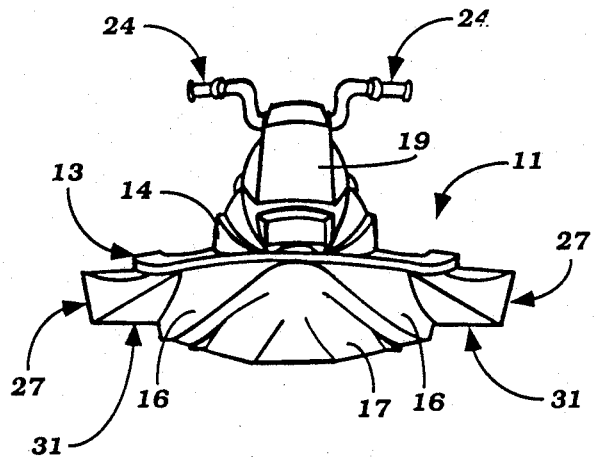
FIG. 3 is a front elevational view of the watercraft.

Referring now in detail to the drawings, a small watercraft constructed in accordance with an embodiment of the invention is identified generally by the reference numeral 11. The small watercraft 11, in the illustrated embodiment, is designed to be operated by a single rider, shown in phantom and identified generally by the reference numeral 12 in FIG. 2. As will become apparent, the watercraft 11 is configured so that the rider 12 rides the watercraft seated in a straddle fashion. However, it is to be understood that certain facets of the invention may be equally as well practiced with other types of watercraft. However, the invention has particular utility in conjunction with small watercraft of this configuration.

The watercraft 11 is comprised of a hull, indicated generally by the reference numeral 13 and which may be formed from a molded, fiber reinforced, plastic material or the like. The hull 13 has a bow portion 14 and a stern portion 15. A pair of generally upstanding side plates 16 extend along opposite sides of the hull from the bow 14 to the stern 15 and define a relatively narrow configuration. A bottom wall 17 extends between the side plates 16 and may be configured with the side plates 16 in such a manner so as to provide the desired handling characteristics. Basically, the bottom 17 of the hull 13 is of the shallow V type.

A deck 18 extends rearwardly from the bow 14 and across the upper ends of the sidewall 16 to a removable cowling portion 19 that encloses an engine compartment. The engine compartment houses any suitable form of propulsion device such as an internal combustion engine of any known type. Since the engine per se forms no part of the invention, it has not been illustrated nor is a further description of it necessary. The engine drives a jet propulsion unit (not shown) that extends along the center line of the hull 13 and which terminates in a steerable discharge nozzle 21 for steering of the watercraft in a known manner.

Rearwardly of the cowling 19 there is provided a raised seat area 22 above the jet propulsion unit and on which the rider 12 may be seated. A pair of depressed foot wells 23 are disposed on opposite sides of the seat 22 and accommodate the feet of the rider 12 as is clearly shown in FIG. 2. A steering handlebar assembly 24 is carried by the cowl 19 forwardly of the seat 22. The handlebar assembly 24 is coupled to the steering nozzle 21 in a known manner so as to permit steering of the watercraft 11.

Figure 4:
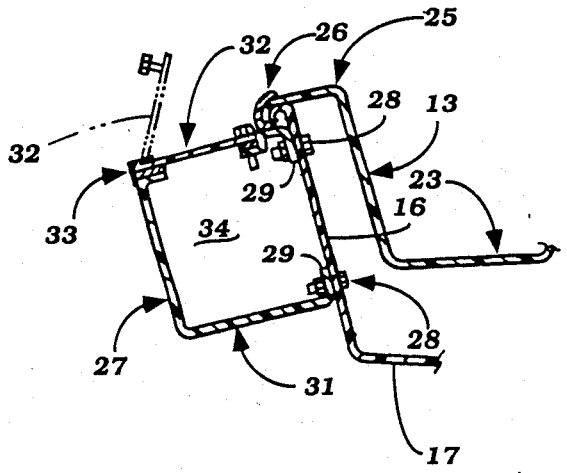
FIG. 4 is an enlarged cross-sectional view taken along the line 4—4 of FIG. 4 showing how the detachable containers are affixed to the hull.

It should be noted that the hull has a generally hollow configuration and as may be best seen in the cross-sectional view of FIG. 4, a pair of raised decks 25 are formed on opposite sides of the foot wells 23. Bumpers 26 may be formed along the peripheral edge of the decks 25 for protection.

It should be readily apparent that the portion of the small watercraft as thus far described and particularly the narrow streamlined hull 13 provides excellent maneuverability and sporting characteristics. However, due to the compact nature of the hull 13 it does not afford any storage capacity to lend itself to long distance cruising nor can it conveniently be employed for other activities such as fishing or the like. In order to give the watercraft more versatility, there are provided a pair of detachable side containers, indicated generally by the reference numeral 27 that provide storage capacity and also will afford more stability to the watercraft for long distance cruising so as to make such cruising more convenient for the operator. The containers 27, as will become apparent, can easily be detached from the hull 13 for more sporting type short distance activities.

The shape of the containers 27 is generally triangular in side elevational view and is rectangular in cross-section as shown in FIG. 4. The containers 27 may, in fact, be of an open wall construction on the side adjacent the side wall 16 of the hull. Threaded fasteners such as bolts and nuts or the like 28 may be passed through the hull and flanges 29 of the containers 27 so as to permit attachment in a watertight manner. In addition, the containers have a lower surface 31 which is complementary to the outer portion of the hull underside 17 so as to prevent water from splashing upwardly onto the occupant 12. In addition, if the weight of the occupant is shifted, the containers 27 will be immersed in the water and add to the buoyancy of the watercraft and its stability. This facilitates long distance running and will assist in reducing the stress on the operator.

Openable hatch covers 32 are supported on the upper sides of the containers 27 by strap hinges 33 so as to afford access to the storage area 34 defined within the containers 27. As a result, many articles such as fishing equipment and the like may be carried within the storage area 34 so as to increase the versatility of the watercraft.

It should be readily apparent from the foregoing description that the overall construction of the watercraft and the use of the detachable containers 27 add greatly to the versatility of the watercraft without sacrificing from its sporting characteristics, if desired. Although an embodiment of the invention has been illustrated and described, various changes and modifications may be made without departing from the spirit and scope of the invention as defined by the appended claims.

I claim:

1. In a hull configuration for a small watercraft comprised of a bow portion and a stern portion and defining a rider's area therebetween, an engine positioned in said bow portion and driving a jet propulsion unit positioned beneath said rider's area for propelling said hull, said hull being defined at least in part by a pair of upstanding side walls, the improvement comprising means for detachably affixing a pair of buoyant containers one to each side of said upstanding side walls for increasing the stability of said hull, at least one of said containers defining internal compartment therein for receiving articles, and openable closure means for accessing said internal compartment.

2. In a hull configuration for a small watercraft as set forth in claim 1 wherein there is a seat adapted to accommodate a rider in a straddle fashion between the sidewalls and rearwardly of the bow.

3. In a hull configuration for a small watercraft as set forth in claim 2 wherein there are a pair of depressed foot area in the hull on opposite sides of the seat to accommodate the rider's feet.

4. In a hull configuration for a small watercraft as set forth in claim 3 wherein the containers add to the width of the hull for providing the buoyancy.

5. In a hull configuration for a small watercraft as set forth in claim 3 wherein the lower surfaces of the containers are configured to prevent water from splashing on the rider.

6. In a hull configuration for a small watercraft as set forth in claim 5 wherein the containers add to the width of the hull for providing the buoyancy.

* * * * *